US005666744A

United States Patent [19]

Thorp

[11] Patent Number: 5,666,744

[45] Date of Patent: Sep. 16, 1997

[54] INFRARED PAPER DRYING MACHINE AND METHOD FOR DRYING A PAPER WEB IN AN INFRARED PAPER DRYING MACHINE

[75] Inventor: Benjamin A. Thorp, Richmond, Va.

[73] Assignee: James River Corporation of Virginia, Richmond, Va.

[21] Appl. No.: 552,123

[22] Filed: Nov. 2, 1995

[51] Int. Cl.[6] ..... F26B 3/34

[52] U.S. Cl. ..... 34/267; 34/635; 34/132

[58] Field of Search ..... 34/267, 269, 412, 34/421, 446, 452, 507, 68, 115, 132, 624, 635, 636

[56] References Cited

U.S. PATENT DOCUMENTS

| | | | |
|---|---|---|---|
| 2,429,338 | 10/1947 | Adams | 34/115 X |
| 2,666,369 | 1/1954 | Niks | 92/38 |
| 3,301,746 | 1/1967 | Sanford et al. | 162/113 |
| 3,303,576 | 2/1967 | Sisson | 34/115 |
| 3,342,936 | 9/1967 | Cole et al. | 34/306 |
| 3,470,063 | 9/1969 | Sanford | 162/303 |
| 3,639,207 | 2/1972 | Genz et al. | 162/146 |
| 3,994,771 | 11/1976 | Morgan, Jr. et al. | 162/113 |
| 4,093,512 | 6/1978 | Fleischer | 162/348 |
| 4,102,737 | 7/1978 | Morton | 162/113 |
| 4,921,750 | 5/1990 | Todd | 428/225 |
| 4,935,077 | 6/1990 | Ellers | 34/267 X |
| 5,066,532 | 11/1991 | Gaisser | 428/137 |

*Primary Examiner*—John M. Sollecito
*Assistant Examiner*—Steve Gravini
*Attorney, Agent, or Firm*—Sixbey, Friedman, Leedom & Ferguson, P.C.; Charles M. Leedom, Jr.; Donald R. Studebaker

[57] ABSTRACT

A paper drying apparatus and method therefor including an infrared drying unit and a vacuum unit, wherein the infrared drying unit emits infrared radiation in a direction toward the vacuum unit. A fabric sheet for carrying a paper web is provided, wherein the fabric sheet passes between the infrared drying unit and the vacuum unit. The infrared drying unit is positioned on the side of the fabric sheet adjacent to the paper web and the vacuum unit is juxtaposed on the opposite side of the fabric sheet from the infrared drying unit, wherein the vacuum unit draws air through the paper web in a direction from the infrared drying unit toward the vacuum unit. The combination of the infrared drying unit with the vacuum units provides a compact arrangement which efficiently removes moisture from the paper web. After passing by the infrared drying unit, the fabric sheet then conveys the paper web toward a final drying drum where the paper web is transferred from the fabric sheet to the final drying drum through the use of a pressure roll.

16 Claims, 2 Drawing Sheets

INFRARED PAPER DRYING MACHINE AND METHOD FOR DRYING A PAPER WEB IN AN INFRARED PAPER DRYING MACHINE

BACKGROUND OF THE INVENTION

1. Technical Field

The present invention relates to a paper drying machine and a method of drying a paper web in a paper drying machine. More particularly, the invention pertains to a paper drying machine which employs infrared drying of a paper web.

2. Background Art

Paper products have conventionally been manufactured by forming a wet paper web on a fabric carrying sheet which then carries the paper web through a paper drying section to remove the excess water from the web. These paper drying sections have conventionally comprised rotatable steam-heated drum dryers over which the paper web traveled, so that the paper web was heated while travelling over the drum dryer to remove moisture from the paper web. The cost of supplying steam to these rotatable drum dryers for heating the dryers is quite high and the ability to maintain uniform drum surface temperatures and humidity in the dryers is difficult. Accordingly, dryer hoods are widely used in connection with these rotary drums, wherein pressurized drying air, instead of steam, is introduced at various points in the hood to contact one exposed surface of the wet web as it professes around the dryer with the exit path for the air being positioned on the other side of the rotary drum. This process is known as through air drying.

U.S. Pat. No. 3,432,936 issued to Sisson discloses one such drying assembly in which a moving stream of pressurized drying air is circulated about a paper web traveling about the periphery of a rotatable roll having apertures formed therein. Sisson utilizes a system where the hot drying air travels from the inside of the rotatable roll to the outside through the apertures, while the web travels about the outer surface of the roll. U.S. Pat. No. 3,432,936 issued to Cole et al. also discloses a drying assembly which utilizes through air drying by employing a configuration which moves drying air from the exterior of a rotatable roll through a paper web and into the interior of the rotatable roll, otherwise known as outside to inside drying air.

One of the most important shortcomings associated with the above-described paper drying machines utilizing through air drying is that the paper web is not uniformly dried throughout its surface due to the permeable carrying sheet which conveys the paper web through the drying procedure. As the drying air is forced through the permeable sheet, the drying air only passes through the permeable areas in the carrying sheet which, in turn, forces the air only through the portions of the paper web adjacent to the permeable areas in the carrying sheet. Therefore, the consistency of the paper web lacks uniformity due to the uneven drying which occurs pursuant to through air drying.

Other methods of drying a paper web have been utilized to more uniformly dry the web, such as passing the paper web under a series of infrared Imps as disclosed in U.S. Pat. No. 2,666,369 issued to Niks. Similarly, U.S. Pat. No. 3,639,207 issued to Genz et al. also discloses the use of infrared lamps to dry a paper web as it passes beneath the infrared lamps, wherein air is forced across the surface of the web to carry away stem that may be created from the heating of the wet paper web. However, no device associated with the prior art draws the hot air created from the infrared lamps through the paper web to increase drying efficiency.

In addition to the foregoing, with conventional paper drying and forming machines, vacuum pumps have been utilized to withdraw moisture from a paper web, such as U.S. Pat. No. 3,301,746 issued to Sanford et al. which discloses passing a wet paper web supported by a Fourdrinier wire over a series of suction boxes. However, these vacuum pumps merely draw the ambient air above the paper web through the web to withdraw moisture therefrom.

Therefore, as can be seen from the foregoing, there is clearly a pressing need for a paper drying machine which removes moisture from a paper web more efficiently as the web passes through a paper making device. In accordance with the present invention, this greater efficiency is accomplished by using an infrared drying device which heats the air about the web with this air being drawn through the paper web by a vacuum pump positioned on the opposite side of the paper web from the infrared drying device. Employing a paper drying apparatus as described above allows for a more efficient removal of moisture from a paper web, while also being compact in comparison to other known moisture removal methods.

SUMMARY OF THE INVENTION

It is a primary object of the present invention to overcome the aforementioned shortcomings associated with the prior art.

Another object of the present invention is to provide a paper drying apparatus which employs infrared radiation for drying a paper web in order to improve bulk, softness and absorbency in the paper web.

Yet another object of the present invention is to provide a paper drying apparatus in which a vacuum device is used in conjunction with the infrared radiation in order to more efficiently dry the paper web.

It is a further object of the present invention to provide a paper drying apparatus which is capable of controlling the temperature profile in zones across the paper web during the drying process.

These as well as additional objects and advantages of the present invention are achieved by manufacturing a paper drying apparatus including an infrared drying device and a vacuum device, wherein the infrared drying device emits infrared radiation in a direction toward the vacuum device. A fabric sheet for carrying a paper web is provided, wherein the fabric sheet passes between the infrared drying device and the vacuum device. The infrared drying device is positioned on the side of the fabric sheet adjacent to the paper web so that the paper web is exposed to infrared radiation before the fabric sheet as the paper web passes by the infrared drying device. The vacuum device is juxtaposed on the opposite side of the fabric sheet from the infrared drying device, wherein the vacuum device draws heated air through the paper web in a direction from the infrared drying device toward the vacuum device. The combination of the infrared drying device with the vacuum devices provides a compact arrangement which efficiently removes moisture from the paper web. After passing by the infrared drying device, the fabric sheet then conveys the paper web toward a final drying drum or other suitable drying device where the paper web is transferred from the fabric sheet to the final drying drum through the use of a pressure roll.

These as well as additional advantages of the present invention will become apparent from the following description of the invention with reference to the several figures.

DETAILED DESCRIPTION OF THE PREFERRED EMBODIMENT

Figure 1:
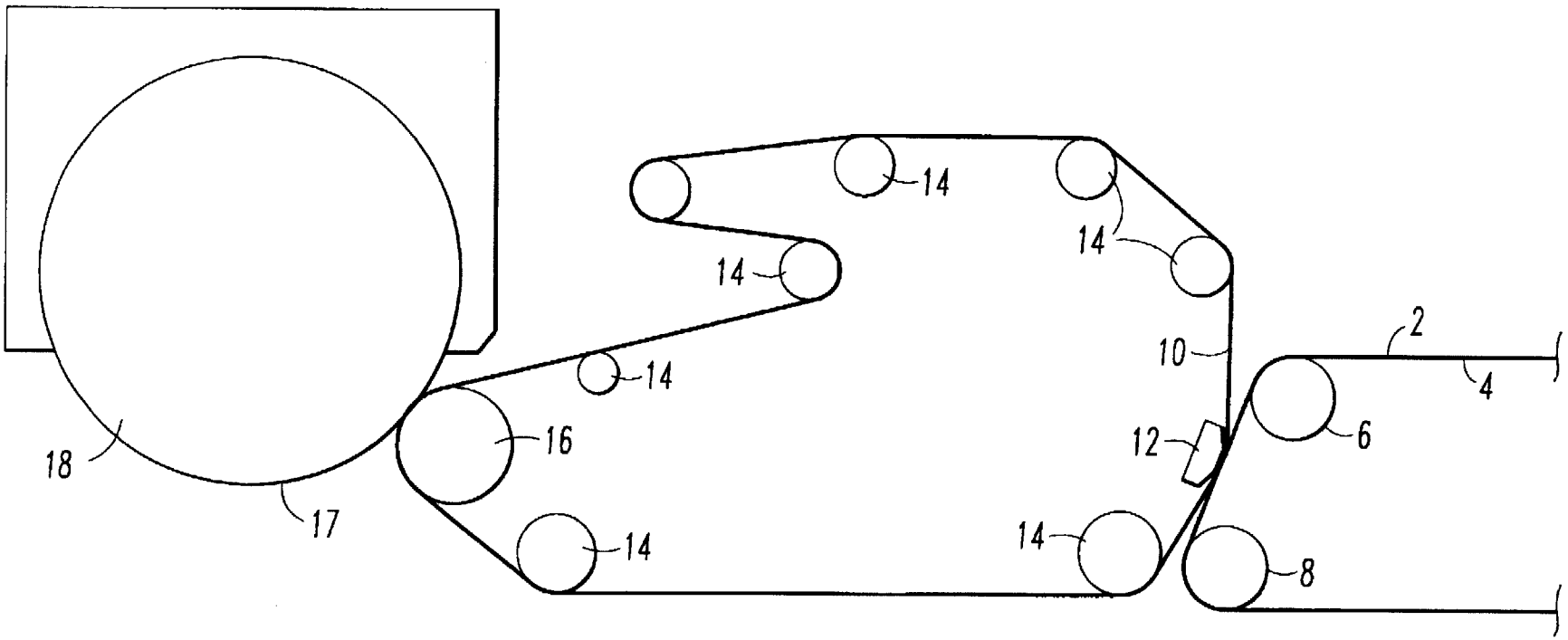
FIG. 1 PRIOR ART
FIG. 1 is a schematic side view of the paper drying machine in accordance with a conventional paper drying apparatus.

Referring now to FIG. 1, a conventional paper drying apparatus is illustrated for removing moisture from a wet paper web 2 which is the product of a paper making machine. The paper web 2 is carded from a paper making process to the drying device by a fabric sheet 4, wherein the fabric sheet travels about the perimeter of couch roller 6 and roller 8. In between rollers 6 and 8, the paper web 2 is contacted by and transferred to fabric sheet 10 as the fabric sheet 10 passes by pick up device 12. Such transfer devices often employ a vacuum to aid in the transfer of the paper web 2 from one fabric sheet to another. After the paper web 2 is transferred to the fabric sheet 10, the fabric sheet 10 conveys the paper web 2 through the drying process. The fabric sheet 10 is entrained through a series of carrier rolls 14 while completing a loop through the drying procedure.

Typically, the paper web 2 is transferred from the fabric sheet 10 to a rotatable drying drum 18, such as a yankee or crepe dryer, as the fabric sheet 10 passes between a pressure roll 16 and the yankee dryer 18. The pressure roll 16 transfers the paper web 2 to the yankee dryer by forcing the fabric sheet 10 against the yankee dryer, the paper web 2 is thus pressed against and transferred to drum 17 of the yankee dryer 18. The pressure between the fabric sheet 10 and the paper web 2 often embosses a pattern, which is present in the fabric sheet 10, onto the paper web 2. Thus the paper web 2 is impulse embossed between the pressure roll 16 and the yankee dryer. However, if the paper web 2 contains too much moisture when it is impulse embossed, the resulting pattern in the paper web 2 is not as pronounced as preferred. Therefore, delivering a semi-dry paper web 2 to the point of impulse embossment would provide an increased depth pattern and an increased ability in the paper web 2 of retaining the embossment. This increased depth pattern also results in improved bulk, softness and absorbency of the paper web product.

Figure 2:
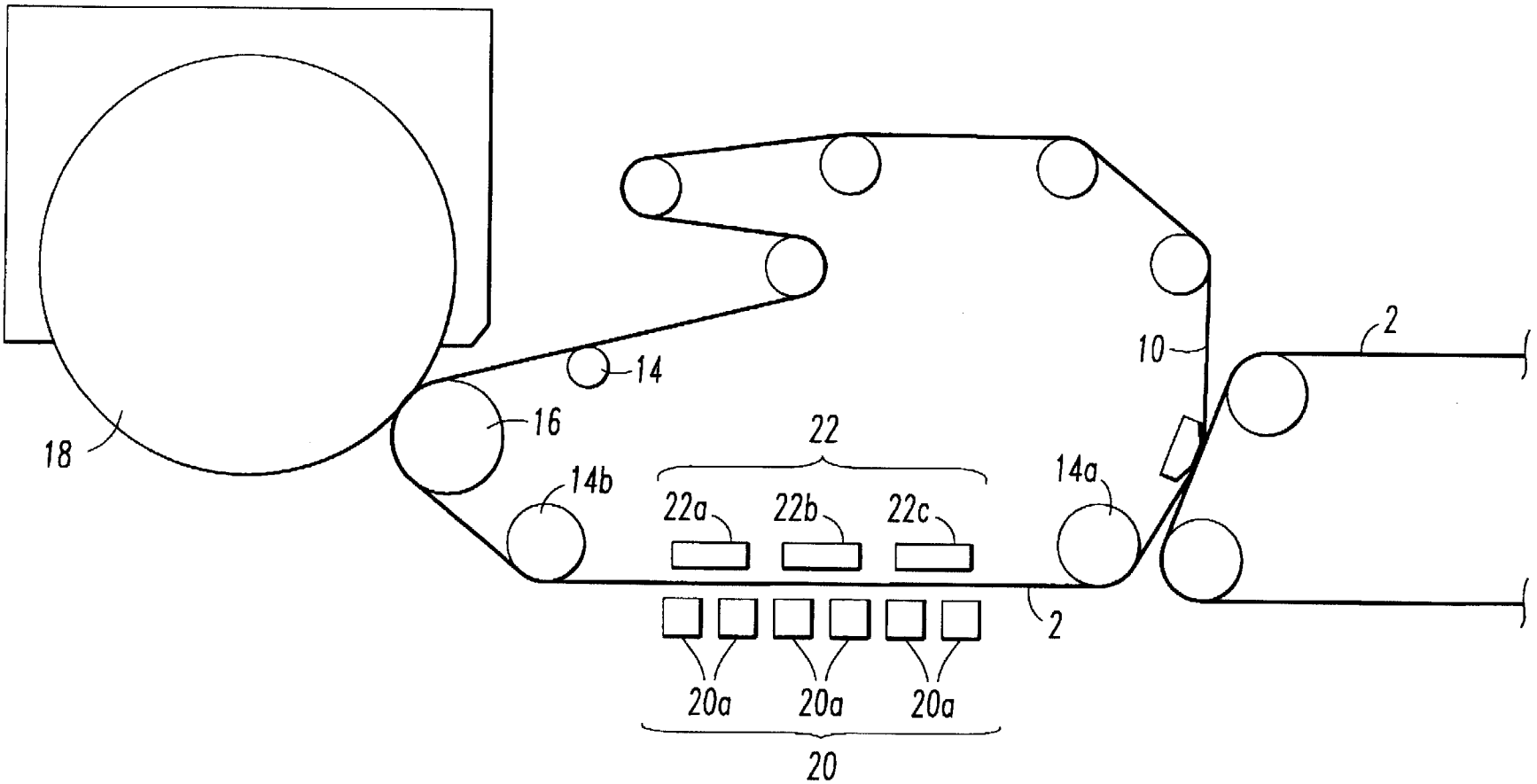
FIG. 2 is a schematic side view of the paper drying machine in accordance with the preferred embodiment of the present invention.

Referring now to FIG. 2, the preferred embodiment of the present invention is disclosed for partially drying paper web 2 as it is entrained between carrying rolls 14*a* and 14*b*. A plurality of drying units 20 employing infrared radiation are positioned between carrying rolls 14*a* and 14*b* adjacent to the paper web 2, so that the fabric sheet 10 conveys the paper web 2 past the infrared drying units 20 during its travel path with the infrared drying units 20 being positioned adjacent to the side of the fabric sheet 10 carrying paper web 2. Therefore, the paper web 2 is heated with infrared radiation as it passes by the infrared drying units 20 as is the air adjacent the paper web 2. The radiation emitted by each infrared drying unit 20*a* may be selectively controlled in order to regulate the temperature profile in zones across the paper web 2. This selective control of infrared drying units 20 allows the drying characteristics of the paper web 2 to be altered to achieve a desired drying uniformity and drying efficiency of the paper web 2.

Further provided are a series of vacuum devices 22*a*, 22*b* and 22*c* forming a vacuum unit 22 positioned on the opposite side of fabric sheet 10 from infrared drying units 20, wherein the vacuum unit 22 draws the hot air generated by the infrared drying units 20 through the paper web 2. By drawing the heated air through the paper web 2 in a direction from the infrared drying units 20 toward the vacuum unit 22, moisture is removed from the paper web 2 in a more rapid fashion than could be accomplished using the infrared drying units 20 without the assistance of vacuum unit 22. This combined process of removing moisture from the paper web 2 using infrared radiation along with vacuum unit 22 increases the consistency of the paper web 2 from about 30% to approximately 60% without having to compact the paper web 2 either mechanically or hydraulically. No compaction occurs due to the composition of fabric sheet 10 being a fabric, whereas conventional use of a felt conveyor allows compaction to occur at the nip between pressure roll 16 and drying drum 18. Therefore, the paper web 2 can be dried while retaining bulk and volume since it does not have to be compacted while increasing web consistency. Further, the vacuum devices 22*a*, 22*b* and 22*c* may be individually and selectively controlled so as to alter the characteristics of the vacuum unit 22 along the length of the paper web 2.

Additionally, the fabric sheet 10 may be imprinted with a desired pattern to be formed in the paper web 2 as the wet paper web 2 conforms to the surface of the fabric sheet 10. As the paper web 2 is dried while being conveyed by the fabric sheet 10, this pattern is retained by the paper web 2. Therefore, using a single fabric sheet 10 to convey the paper web 2 through the drying process assists in forming this design pattern in the paper web, while transferring the paper web to another conveying sheet would prevent the registering of the fabric imprint in the paper web 2. This pattern is further embossed into the paper web 2 when the paper web 2 and fabric sheet 10 pass between pressure roll 16 and rotatable drying drum 18, since the force delivered by pressure roll 16 serves to impulse emboss the paper web 2 against the fabric sheet 10 which further embosses the pattern from the fabric sheet 10 into the paper web 2. Impulse embossing the semi-dry paper web 2, having approximately 60% sheet consistency after passing through the infrared drying procedure, serves to improve bulk, softness and absorbency in the paper web 2. The fabric sheet may comprise Kevlar fabric or other polymer fabrics which are capable of withstanding the heat involved with the infrared drying.

The use of infrared drying units 20 along with vacuum unit 22 provides numerous advantages over other systems, such as through-air-drying rolls, used to increase sheet consistency by partially drying the paper web 2 before transferring it to a yankee dryer. The combined drying procedure disclosed in the present invention is extremely compact in comparison with the large drying rolls required for through-air-drying, wherein this compact arrangement allows the infrared drying units 20 and vacuum unit 22 to be installed in conventional paper drying machines, as shown in FIG. 1, using the existing available space. Therefore, there would be little downtime or costs associated with downtime in a paper drying machine being retrofitted to employ the drying apparatus of the present invention. An additional advantage the present invention provides over the prior art drying machines is that prior machines were limited in choice of energy used to power the drying machine. For instance, since the scent of the paper web is crucial in most applications of the final paper product, many energy sources cannot be used because they impart an odor into the paper web. Most systems using through-air-drying rolls must use natural gas as an energy source, since natural gas does not impart an odor in the web while providing the necessary energy for the drying rolls; additionally, electricity cannot efficiently provide the energy required for through-air-drying systems. However, the drying system of the present invention allows for the use of electricity, natural gas or other non-odor imparting energy sources. Therefore, the drying apparatus of the present invention can be utilized in areas where natural gas might not be prevalent or cost effective.

Having described the process and product of this invention, the following examples are intended to illustrate modes of advantageous operation, but it will be understood that those skilled in the art will immediately be aware of other advantages stemming from the herein disclosed inventive concept. It is understood, therefore, that the examples are intended to be illustrative and not limiting, and the scope of invention is only to be construed by the scope of the appended claims.

EXAMPLE 1

A wet paper web comprising 30% solids is delivered to the infrared drying assembly at 4000 feet per minute by a fabric sheet, wherein the fabric sheet may comprise a felt sheet. The wet paper web has a typical towel wire weight of 24 lbs. per 3000 sq. ft., where this is the dry fiber weight of the paper web at the end of the forming process. Conveying the wet paper web through the infrared drying assembly at this speed requires 11.3 gas frames, approximately 20 feet of infrared radiation exposure when powered by gas, or 5.8 electric frames, approximately 10.3 feet of infrared radiation exposure when electricity is used to power the infrared units, to increase the percentage of solids in the paper web from 30% to 60% when the paper web enters the drying assembly having a temperature of approximately 100° F. Alternatively, if the paper web enters the infrared drying assembly at a temperature of approximately 180° F. then the final percentage of solids in the paper web will be close to 65%. This drying process removes 1,776 lbs. of water per hour per cross direction foot, wherein the process requires 2,094,378 Btu per hour per cross direction foot. This accounts for an evaporation rate of 1,179 Btu per pound of water removed, which is more efficient than the through-air-drying process.

EXAMPLE 2

A wet paper web comprising 30% solids is delivered to the infrared drying assembly at 4000 feet per minute by a fabric sheet. The wet paper web has a towel wire weight of 12 lbs. per 3000 sq. ft., where this is the dry fiber weight of the paper web at the end of the forming process. Conveying the wet paper web through the infrared drying assembly at this speed requires 5.5 gas frames, approximately 10 feet of radiation exposure when powered by gas, or 2.8 electric frames, approximately 5 feet of radiation exposure electricity is used to power the infrared units, to increase the percentage of solids in the paper web from 30% to 60% when the paper web enters the drying assembly having a temperature of approximately 100° F. Alternatively, if the paper web enters the infrared drying assembly at a temperature of approximately 180° F. then the final percentage of solids in the paper web will be close to 65%. This drying process removes 864 lbs. of water per hour per cross direction foot, wherein the process requires 1,018,886 Btu per hour per cross direction foot. This again accounts for an evaporation rate of 1,179 Btu per pound of water removed.

As can be seen from the foregoing, a drying apparatus for a paper web employing infrared drying in conjunction with a vacuum device in accordance with the present invention achieves optimal bulk, softness and absorbency in the paper web in the most efficient manner.

While the present invention has been described with reference to a preferred embodiment, it should be appreciated by those skilled in the art that the invention may be practiced otherwise than as specifically described herein without departing from the spirit and scope of the invention. It is, therefore, to be understood that the spirit and scope of the invention be limited only by the appended claims.

What is claimed is:

1. A drying apparatus for a wet paper web comprising:

a substantially continuous fabric sheet for carrying a paper web;

an infra-red drying means positioned below said fabric sheet with respect to a plane formed by said paper web and said fabric sheet for delivering energy upwardly to said paper web, said paper web being conveyed by said fabric sheet with said paper web positioned adjacent to said infra-red drying means; and a vacuum means positioned above said fabric sheet with respect to said plane for drawing air through said paper web and said fabric sheet for drying said paper web while minimizing compacting of said paper web.

2. The drying apparatus as defined in claim 1, wherein said paper web is conveyed by said fabric sheet with said paper web being positioned between said fabric sheet and said infra-red drying means.

3. The drying apparatus as defined in claim 2, wherein said vacuum means is juxtaposed across from said infra-red drying means.

4. The drying apparatus as defined in claim 1, wherein said fabric sheet comprises a patterned open mesh fabric.

5. The drying apparatus as defined in claim 1, wherein said infrared drying means may be selectively controlled to vary the energy delivered to different regions of said paper web.

6. The drying apparatus as defined in claim 1, wherein said vacuum means may be selectively controlled to vary the air drawn through different regions in said paper web.

7. The drying apparatus as defined in claim 1, wherein said infrared drying means heats said paper web to a temperature of approximately 180° F.

8. The drying apparatus as defined in claim 1, wherein the drying apparatus removes at least approximately 1,776 lbs. of water per hour per cross direction foot of the paper web for a paper web having a wire weight of 24 lbs. per 3000 sq. ft.

9. The drying apparatus as defined in claim 1, wherein the drying apparatus removes at least approximately 864 lbs. of water per hour per cross direction foot of the paper web for a paper web having a wire weight of 12 lbs. per 3000 sq. ft.

10. A drying apparatus for a wet paper web comprising:

a fabric sheet for carrying a paper web through at least a portion of the drying apparatus along a substantially horizontal plane;

an infrared heating means for delivering energy to one side of said paper web, said paper web being conveyed by said fabric sheet adjacent to said infrared drying means along said substantially horizontal plane; and a vacuum means juxtaposed to said infrared heating means for drawing air heated by said infrared heating means through said paper web and said fabric sheet.

11. The drying apparatus as defined in claim 10, wherein said fabric sheet comprises a patterned open mesh fabric.

12. The drying apparatus as defined in claim 10, wherein said infrared heating means may be selectively controlled to vary the energy delivered to different regions of said paper web.

13. The drying apparatus as defined in claim 10, wherein said vacuum means may be selectively controlled to vary the air drawn through different regions in said paper web.

14. The drying apparatus as defined in claim 10, wherein said infrared heating means heats said paper web to a temperature of approximately 180° F.

15. The drying apparatus as defined in claim 10, wherein the drying apparatus removes at least approximately 1,776 lbs. of water per hour per cross direction foot of the paper web for a paper web having a wire weight of 24 lbs. per 3000 sq. ft.

16. The drying apparatus as defined in claim 10, wherein the drying apparatus removes at least approximately 864 lbs. of water per hour per cross direction foot of the paper web for a paper web having a wire weight of 12 lbs. per 3000 sq. ft.

* * * * *